US005212039A

United States Patent [19]

Demizu et al.

[11] Patent Number: 5,212,039

[45] Date of Patent: May 18, 1993

[54] DEVELOPING METHOD OF ELECTROSTATIC LATENT IMAGES FOR FULL COLOR IMAGE FORMATION

[75] Inventors: Ichiro Demizu, Toyonaka; Mitsutoshi Nakamura, Ibaragi; Hiroshi Fukao, Toyokawa; Yuji Shintani, Toyohashi; Shinobu Nakasawa, Toyohashi, all of Japan

[73] Assignee: Minolta Camera Kabushiki Kaisha, Osaka, Japan

[21] Appl. No.: 799,343

[22] Filed: Nov. 27, 1991

[30] Foreign Application Priority Data

Nov. 30, 1990 [JP] Japan ..... 2-337542

[51] Int. Cl.[5] ..... G03G 13/09

[52] U.S. Cl. ..... 430/122; 430/106.6; 430/110; 430/111

[58] Field of Search ..... 430/102, 106.6, 111, 430/122

[56] References Cited

U.S. PATENT DOCUMENTS 4,447,517 5/1984 Yuge et al. ..... 430/122
4,623,605 11/1986 Kato et al. ..... 430/110
4,675,267 6/1987 Haneda et al. ..... 430/102
4,758,493 7/1988 Young et al. ..... 430/106.6 X
4,797,335 1/1989 Hiratsuka et al. ..... 430/102 X
4,943,507 7/1990 Takahashi et al. ..... 430/122 X

FOREIGN PATENT DOCUMENTS 2-79862 3/1990 Japan .
2-108069 4/1990 Japan .

*Primary Examiner*—Roland Martin
*Attorney, Agent, or Firm*—Burns, Doane, Swecker & Mathis

[57] ABSTRACT

This invention relates to a developing method for electrostatic latent images for developing the electrostatic latent images retained on an electrostatic latent image retaining member, comprising a step of supplying a specified developer;

a step of transferring the developer to a developing area; and a step of developing the electrostatic latent images formed on the electrostatic latent image retaining member in the development area under a specified development bias voltage.

16 Claims, 1 Drawing Sheet

DEVELOPING METHOD OF ELECTROSTATIC LATENT IMAGES FOR FULL COLOR IMAGE FORMATION

BACKGROUND OF THE INVENTION

This invention relates to a developing method of electrostatic latent images for full color image formation.

Electrophotographic methods are widely used in PPC, printers, facsimiles and the like. A full color image formation methods which reproduce multicolor by laminating plural kinds of color toners have been used.

A developing method excellent in developing characteristics is required in these full color developing methods since the methods are mainly used for copying the manuscripts containing pictures, photographs, graphics and the like. In such a developing method, a bias voltage with an alternating current component superposed on a direct current component is applied on a developer retaining member that retains and transfers the developer.

Because the developer is vibrated and stirred more strongly in the development area by the superposed alternating current component, a toner lowly charged or heterogeneously charged is liable to be scattered by a vibration phenomenon, resulting in toner fogs or toner dirts of the interior of the apparatus by the toner. Therefore, a toner with homogeneous and appropriate amount of electrostatic charge should be supplied to the developing method. One possible method for solving the problem is to add a charge controlling agent suppressing agent to the toner. The agents having excellent characteristics for controlling the electrostatic charge are, however, usually colored, and can not be used in the full color toner. The problem of chargeability is, therefore, has not yet been settled enough.

Polyester resins with low viscosity are used for a binder resin for full color toner because of security of light-transmittance and adhesive properties among multilayers of copied images. The polyester resins, however, have some problems arising from their properties. For example, so called spent phenomenon of the toner in which the toner adheres to the surface of the carrier is liable to occur because of low viscosity of the binder resin for the toner. The spent toner is particularly liable to occur in the developing method in which an alternative current component is superposed on a direct current component, since a stress will be generated between the toner and the carrier by a vibration phenomenon.

While a fluidizing agent is added in a developer to improve fluidity, the agent is buried into a toner when viscosity of the toner is low. The fluidity is deteriorated. There is also another problem that characteristics of the toner varies largely by the environment because the polyester resins have —OH and/or —COOH groups in their molecular terminals.

SUMMARY OF THE INVENTION

The object of the invention is to provide a developing method in which copied images excellent in image quality such as texture and gradient can be formed without toner fogs and toner-spent phenomenon.

This invention relates to a developing method for electrostatic latent images for developing electrostatic latent images retained on an electrostatic latent image retaining member, comprising a step of supplying a specified developer;

a step of transferring the developer to a developing area; and a step of developing the electrostatic latent images formed on the electrostatic latent image retaining member in the development area under a specified development bias voltage.

DETAILED DESCRIPTION OF THE INVENTION

Figure 1:
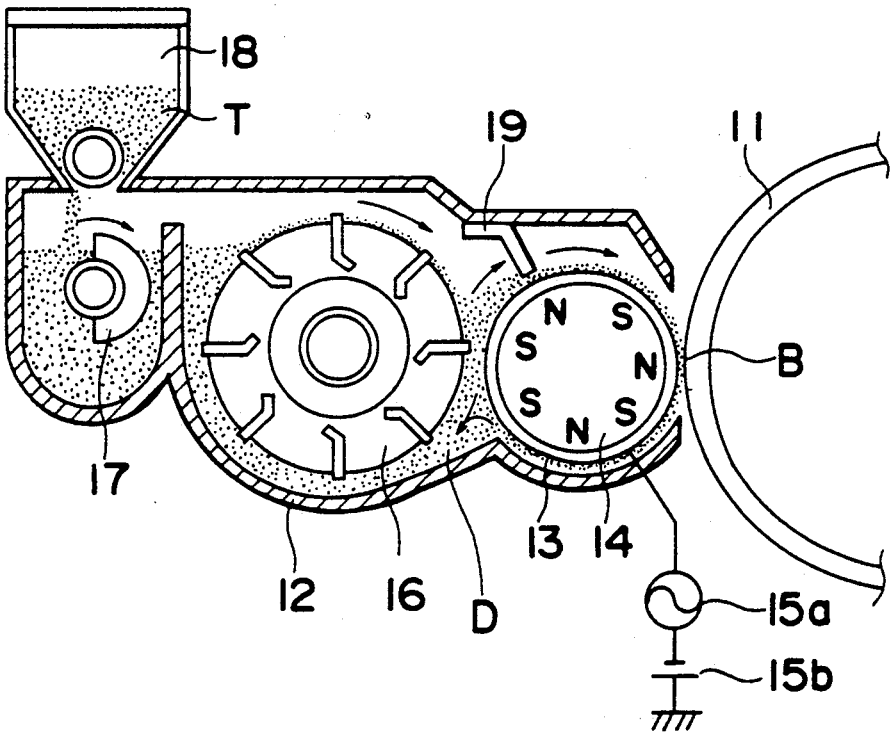
FIG. 1 shows a schematic constitutional view of one of apparatus to practice a developing method for electrostatic latent images according to this invention.

This invention provides a developing method for electrostatic latent images in which copied images excellent in image qualities such as fine texture and gradient can be formed without toner fogs and toner spent phenomenon.

The object of this invention is achieved by a developing method for electrostatic latent images for developing the electrostatic latent images retained on an electrostatic latent image retaining member, comprising a step of supplying a developer comprising a toner comprising a polyester resin with $2500 \leqq Mn \leqq 12000$, $2 \leqq Mw/Mn \leqq 6$, 50° C. $\leqq Tg \leqq 70°$ C. and 80° C. $\leqq Tm \leqq 120°$ C. and a coloring agent, a carrier comprising a magnetic core material coated with a thermosetting resin in which a styrene-acrylate copolymer resin and melamine resin are crosslinked, and a post-treatment agent comprising a hydrophobic silica and a hydrophobic titanium oxide or a hydrophobic silica and a hydrophobic aluminum oxide on a developer retaining member of non-magnetic property which contains a magnetic member in it and is arranged oppositely to the electrostatic latent image retaining member;

a step of transferring the developer to a developing area which is formed in an opposite portion of the electrostatic latent image retaining member to the developer retaining member; and a step of developing the electrostatic latent images formed on the electrostatic latent image retaining member in the development area under a development bias in which an alternating current component with a frequency of 1000 to 3500 Hz and peak-to-peak voltage of 300 to 2500 V is superposed on a direct current component The developing method for electrostatic latent images according to this invention is a magnetic brush developing method. A developer retaining member of non-magnetic property containing a magnetic member built therein is provided oppositely to the surface of a rotatably arranged photosensitive member. A developer supplied to the developer retaining member is transferred to the developing area where the developer retaining member and photosensitive member are brought close with each other while the developer is held on the outer surface of the developer retaining member by a magnetic force of the magnetic member. The transfer is carried out by a transfer method of revolving the developer retaining member and the magnetic member in the same or reversed direction with each other, or a method of revolving either one of the developer retaining member or magnetic member in a direction.

A development bias component is superposed on the developer retaining member, and the developer serves for developing electrostatic latent images on the surface of a photosensitive member in the development area while being subjected to a vibrating and stirring action by a vibrating electric field generated between the developer retaining member and the photosensitive member.

The alternating current component applied as a development bias is superposed within a range of frequency (f) of 1000 to 3500 Hz, peak-to-peak voltage of 300 to 2500 V in the relation between the frequency (f) and the peak-to-peak voltage $V_{p-p}$ represented by the equation [I];

$$V_{p-p} \leqq f + 500 \quad [I]$$

When the frequency (f) is smaller than 1000 Hz, copied images become rough. In the lower frequency of 500 Hz or less, a stripe pattern appears in copied images. Effect of superposition by alternating current component can not be obtained when frequency (f) is greater than 3500 Hz, since vibration of the toner can not follow vibration of the electric field.

When the peak-to-peak voltage is less than 300 V, the toner can not be endowed with sufficient vibration and the superposition effect of the alternating current component is not effective. When the peak-to-peak voltage is larger than 2500 V, toner fogs are formed. When the relation between frequency (f) and peak-to-peak voltage does not satisfy the equation [I], toner fogs are also formed. It is preferable in this invention that the frequency is in the range between 1000 and 2000 Hz and the peak-to-peak voltage is within in the range between 500 V and 2000 V and f and $V_{p-p}$ satisfies the equation [I].

The development of electrostatic latent images by a developer held on a developer retaining member in the development area is carried out by a contact developing method in which the electrostatic latent image retaining member and the magnetic brush are brought into contact with each other, or by a jumping developing method in which the electrostatic latent image retaining member and the magnetic brush are not brought into contact with each other.

Problems such as toner scattering, toner fogs and spent toner may arise when characteristics of a developer is not so sufficient, even if a bias voltage for development is superposed in the range described above. These problems can be solved by using a developer as described below. Such a developer is composed of a toner and a carrier. First, the toner is explained.

A toner of the present invention comprises at least polyester resins and coloring agents.

Examples of the polyester resins are the products of condensation polymerization of polyols such as bisphenols, ethyleneglycol, triethyleneglycol, 1,2-propyleneglycol and 1,4-butanediol, with aliphatic unsaturated difunctional acids such as maleic acid and itaconic acid, or difunctional acids such as phthalic acid, terephthalic acid, isophthalic acid, malonic acid and succinic acid. The use of modified polyester resins in which aromatic vinyl monomers are subjected to graft-polymerization with unsaturated polyester resins is preferable from the viewpoint of improving environmental stability. The amount of polyesters in the modified polyesters is more than 50% by weight, preferably from 60 to 90% by weight.

Aromatic vinyl monomers for the modified polyesters are exemplified by styrene, α-methylstyrene, vinyltoluene and p-ethylstyrene.

The other vinyl monomers can be also used together with the aromatic vinyl monomers, being exemplified by alkyl methacrylate such as methyl methacrylate, butyl methacrylate, octyl methacrylate and stearyl methacrylate; alkyl acrylate such as ethyl acrylate, propyl acrylate, butyl acrylate and octyl acrylate; acrylonitrile and acrylamide; or vinyl monomers containing amino group such as dimethylaminoethyl methacrylate, diethylaminoethyl methacrylate, dimethylaminoethyl acrylate and dimethylaminopropyl methacrylate.

Suitable polyesters contained in toner have average molecular weight (Mn) of 2500 to 12000, degree of dispersion (Mw/Mn) of 2 to 6, glass transition (Tg) of 50° to 70° C. and melting point (Tm) of 80° to 120° C. When these characteristics are not filled, light-transmittable property of toner will be insufficient and fixing ability and heat resistance will be decreased.

Examples of coloring agents are C.I. Pigment Yellow 12, C.I. Pigment Yellow 13 and the like as a yellow coloring agent, C.I. Pigment Red 122, C.I. Pigment Red 57:1 and the like as a red coloring agent, and C.I. Pigment Blue 15 and the like as a blue coloring agent. The coloring agents are, however, not limited to those mentioned above, but various kinds of pigments or dyes conventionally used for light-transmittable colored toners can be also used.

Desired additives such as a charge controlling agent can be added other than coloring agents to the toner of the invention.

A light-transmittable toner is prepared by kneading and pulverizing a binder resin, additives such as coloring agents and others required in this invention in a conventional amount to have a mean particle size of 4 to 25 μm.

Hydrophobic silica and hydrophobic titanium oxide, or hydrophobic silica and hydrophobic aluminum oxide are added externally to a toner of the present invention.

The silica used in this invention is identical with those used in conventional toners, which have a primary particle size of 5 to 20 mμm and is subjected to hydrophobic treatment. Various kinds of hydrophobic silica such as hydrophobic silica R-972 (primary particle size 16 mμm; made by Nippon Aerosil K.K.), hydrophobic silica R-974 (primary particle size 12 mμm; made by Nippon Aerosil K.K.) and hydrophobic silica R-976 (primary particle size 7 mμm; made by Nippon Aerosil K.K.) are available in the market. The addition of silica enables improvement in fluidity of a developer as well as raise of amount of electrostatic charge on the toner.

Silica is added in an amount of 0.1 to 1.0% by weight, preferably 0.1 to 0.5% by weight relative to a toner in this invention. When the amount is less than 0.1% by weight, the addition of silica is not effective. When the amount is over 1.0% by weight, high level of electrostatic charge or inferior environment resistivity can not be improved.

Hydrophobic titanium oxide or hydrophobic aluminum oxide is further added in this invention other than the conventional silica.

The addition of the above-mentioned titanium oxide or aluminum oxide can solve the problem of decrease in fluidity under the repeated operation due to burying of silica in the toner, in particular, constituted of polyesters of low viscosity, and the problem of exceedingly high electrostatic charge brought about by the addition of silica or the problem of circumstantial stability.

Titanium oxide or aluminum oxide used preferably has a peak of primary particle distribution in the range of 10 to 20 mμm and in the range of 30 to 60 mμm.

Titanium oxide or aluminum oxide particle having a peak of primary particle distribution in the range of 10 to 20 mμm (referred to "small particle" hereinafter) is used to control a high electrostatic charge level of silica and to improve environmental resistivity, while the advantages of silica such as excellent fluidity and ability of forming copied images with fine texture are kept.

Since a light-transmittable toner is constituted of a binder resin with lower molecular weight, i.e. a softer resin compared with that used in conventional black toner in order to secure light-transmittance, the problem of burying the silica or small particles into the toner becomes remarkable.

The use of titanium oxide or aluminum oxide having a peak of primary particle distribution in the range of 30 to 60 mμm (referred to "large particle" hereinafter) effectively prevents silica or small particles from burying into toner particles, and maintains fluidity and electrostatic charge stability for a long time. The total amount of large particles and small particles is from 0.2 to 3.0% by weight, preferably from 0.2 to 2.0% by weight relative to the amount of toner. When the amount is less than 0.2% by weight, the effect of addition of the fine particles can not be obtained When the amount is larger than 3.0% by weight, electrostatic charge level becomes low.

The mixing ratio of small particles with large particles is 1:9 to 1:1, preferably 1:4 to 2:3. A developer excellent in the characteristics such as fluidity, electric charging ability and fine texture in copied images can be obtained. Silica and fine particles can be effectively prevented from burying in a toner.

Titanium oxide or aluminum oxide added to a toner is subjected to hydrophobic treatment to improve environmental stability.

Examples of hydrophobic agents used are various coupling agents such as silanes, titanates, aluminates, and zirco-aluminates. The silanes are exemplified by chlorosilane, alkylsilane, alkoxysilane and silazane.

A carrier, which is one of component of a developer of the present invention, is explained hereinafter.

A carrier of the present invention is composed of core materials comprising magnetic materials coated with a coating resin of a styrene-acrylate resin having hydroxyl group which is cross-linked with a melamine resin.

The coating layer-forming resin can have an excellent electric charging abilities by friction to above-described polyester-based toner.

The amount of coating resin on a carrier is preferably 2.7 to 3.5% by weight relative to the carrier. When the amount is less than 2.7% by weight, the surface of the core material is difficult to be coated with the resin completely, whereby carrier development is liable to occur due to the decrease in electric resistivity of the carrier. The carrier development on copy ground in a full color copy process brings about a problem of noise in copied images because the carrier is black in general. When the amount of the coating resin is larger than 3.5% by weight, the carrier particles are liable to aggregate at the formation of coating layer.

Weight decrease of the carrier according to this invention should preferably be 7% by weight or less on the basis of the coating resin when the resin is heated at 180° C. for 2 hours. Problems such as carrier blocking during long term storage, spent toner and instability in electrostatic charging property are brought about by the influence of non-cross linked components, solvent and catalyst remaining in the resin when the amount is larger than 7% by weight. Toner particles are liable to be spent in the development area especially in the developing method in which an alternating current component is superposed on the development bias voltage.

It is preferable that the heat decomposition peak temperature of a coating layer is 275° C. or more in the present invention. Heat resistivity of the carrier is improved when the coating resin has a heat decomposition peak temperature of 275° C. or more.

The use of core materials with mean particle size of 40 to 60 μm is desirable. Particle size of more than 60 μm will result in roughness of copied images or appearance of brush stripes by magnetic brush while adhesion of carrier is liable to occur when particle size is less than 40 μm. Known magnetic materials of metals such as ferrite, magnetite, iron, nickel and cobalt; alloys or admixtures of these metals with metals such as zinc, antimony, aluminum, lead, tin, bismuth, beryllium, manganese, selenium, tungsten, zirconium and vanadium; admixtures of these metals with metal oxides such as iron oxide, titanium oxide and magnesium oxide, nitrides such as chromium nitride or vanadium nitride and carbides such as silicone carbide or tungsten carbide, ferromagnetic ferrites or mixtures thereof can be applied as magnetic materials to be used for core materials.

Developers applied to a developing method for electrostatic latent images according to this invention are prepared by mixing a predetermined amount of toners and carriers. The amount of the toner relative to the developer is in the range from 3 to 10% by weight, which is not necessarily different from that used conventionally.

FIG. 1 shows an example of development apparatus to be used for a developing method of electrostatic latent images according to the present invention.

In FIG. 1, the number (12) represents a development apparatus and the number (11) a drum for photosensitive member, the number (13) a developer retaining member, the number (14) a magnetic member, the number (16) a bucket roller, the number (17) a spiral screw, the number (18) a toner hopper, the number (19) a layer thickness regulating blade, the (D)a developer and the (T) a toner, respectively, in the development apparatus (12).

A bias voltage in which alternating current component (15*a*) is superposed on direct current component (15*b*) is applied on the developer transfer member (13) as a bias voltage in the development apparatus. The developer (D) in the development apparatus (12) is mixed and stirred by the spiral screw (17) and the bucket roller (16) rotating in the direction indicated by an arrow in the figure. The mixed and stirred developer is supplied on the developer retaining member (13), regulated to a layer of predetermined thickness by the layer thickness regulating blade (19), transferred in the direction indicated by the arrow by rotation of the developer retaining member (13) and arrives at the development area (B) where electrostatic latent images are developed on the surface of the photosensitive member (11).

Although toner is liable to scatter or drop in the development area (B), the use of a developer described above in the developing method according to the present invention makes it possible to realize the advantages such as excellent electrification-build up properties, effective endowment of a toner with sufficient and appropriate amount of electrostatic charge and prevention of scattering. Toner scattering, toner dropping and toner fogs can be prevented because toner does not aggregate with each other. Occurrence of spent toner due to the vibration phenomenon in the development area (B) can be also prevented.

Embodiments of this invention are described using concrete examples hereinafter.

MANUFACTURING EXAMPLE 1 OF TITANIUM

Titanium dioxide (MT600B; made by Teika K.K.) with primary particle size of 50 mμm and titanium dioxide (MT150A; made by Teika K.K.) with primary particle size of 15 mμm were mixed in the ratio of 7 (MT600B) to 3 (MT150A). One hundred of the obtained mixture was spray-coated by a solution of 5 parts by weight of silicone oil represented by the following structural formula [i]:

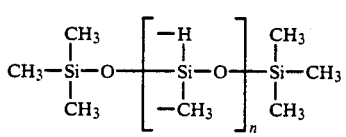

[i]

(wherein n = 30~50)

diluted by xylene of 50 parts by weight. After dried, the obtained titanium dioxide was heat-treated at 150° C. for 1 hour. Thus, hydrophobic titanium dioxide A was obtained.

MANUFACTURING EXAMPLE 2 OF TITANIUM

Titanium dioxide (MT600B; made by Teika K.K.) with primary particle size of 50 mμm was treated by the same method as was described in Manufacturing Example 1. Thus, hydrophobic titanium dioxide B was obtained.

MANUFACTURING EXAMPLE 1 OF COLOR TONER

In a flask, 68 parts by weight of polyoxyethylene(2)-2,2-bis(4-hydroxypheny)propane, 16 parts by weight of isophthalic acid, 16 parts by weight of terephthalic acid, 0.3 parts by weight of maleic anhydride and 0.06 parts by weight of dibutyl tin oxide were added and the mixture was allowed to be treated at 230° C. for 24 hours under nitrogen atmosphere, and the product was taken out. A polyester resin containing an unsaturated polyester was obtained.

The polyester resin had average molecular weight of 10,600.

In a flask, 50 parts by weight of this polyester resin and 50 parts by weight of xylene was added and dissolved. Reaction temperature was raised until xylene began to reflux, and a solution of 0.4 parts by weight of azobisisobutyronitrile in 13 parts by weight of styrene and 2 parts by weight of methyl methacrylate was added dropwise in 30 minutes under refluxing of xylene in nitrogen stream. The temperature was kept for 3 hours after the addition. After xylenes was evaporated under reduced pressure, the resin was taken out. Thus, a binder resin having weight average molecular weight of 13,100, melting viscosity at 100° C. of $6\times10^4$ poise and glass transition temperature of 63° C. was obtained.

For the measurement of melting viscosity, a flow tester CFT-500 made by Shimazu K.K. was used. Measuring conditions were 1 mm in nozzle diameter, 1 mm in nozzle length, 30 kg in applied weight and 3° C. in temperature increase rate.

(i) Yellow toner

| | Parts by weight |
|---|---|
| Polyester resin modified by styrene-methacrylate | 100 |
| Organic pigment Lionol Yellow FG-1310 (made by Toyo Ink K.K.) | 2.5 |
| Charge controlling agent | 3 |

(Bontron E-84; made by Oriento Kagaku K.K.)

The above-described materials were thoroughly mixed in a Henschel mixer, kneaded in a two-axial extruder and cooled. The mixture was roughly crushed by a feather-mill and then finely pulverized in a jet-grinder and classified by an air-classifier to obtain yellow particles of 5 to 25 μm in particle size (mean particle size: 10.5 μm).

To the yellow particles described above, 1.0% by weight of hydrophobic titanium A obtained in Manufacturing Example of titanium and 0.2% by weight of hydrophobic silica (H2000/4; made by Wacker K.K.) were added and mixed in a Henschel mixer. Thus, an Yellow toner (1) was obtained.

(ii) Magenta toner

Magenta toner (1) was manufactured by the same method as was used in above-described Yellow toner, except that 2.5 parts by weight of Lionol Red 6B FG-4213 (made by Toyo Ink K.K.) was used as a pigment.

(iii) Cyan toner

Cyan toner (1) was manufactured by the same method as was used in above-described Yellow toner, except that 2.5 parts by weight of Lionol Blue-7350 (made by Toyo Ink K.K.) was used as a pigment.

(iv) Black toner

Black toner (1) was manufactured by the same method as was used in above-described Yellow toner, except that 25. parts by weight of carbon black MA#8 (made by Mitsui Kasei K.K.) was used as a pigment.

MANUFACTURING EXAMPLE 2 OF COLOR TONER

Yellow toner (2), Magenta toner (2), Cyan toner (2) and Black toner (2) were manufactured by the same method as was used in Manufacturing Example 1 of above-described color toner, except that hydrophobic titanium B was used instead of hydrophobic titanium A.

MANUFACTURING EXAMPLE 3 OF COLOR TONER

Yellow toner (3), Magenta toner (3), Cyan toner (3) and Black toner (3) were manufactured by the same method as was used in Manufacturing Example 1 of color toner, except that hydrophobic titanium A was not used but hydrophobic silica (H2000/4; made by Wacker K.K.).

MANUFACTURING EXAMPLE 1 OF CARRIER

Eighty parts by weight of a styrene-acrylic copolymer composed of styrene, methyl methacrylate, 2-hydroxyethyl acrylate and methacrylic acid (1.5:7:1.9:0.5) and 20 parts by weight of butylated melamine resin were diluted with toluene to prepare a styrene-acrylic solution with 2% in solid fraction.

Sintered ferrite powder (F-300; mean particle size: 50 μm, bulk density: 2.53 g/cm$^2$; made by Powdertech K.K.) was used as a core material and the material was coated with the styrene-acrylic solution by means of a spiller coater (made by Okada Seiko K.K.) and dried. The carrier obtained was allowed to stand in a hot-air circulation oven at 120° C. for 2 hours to be sintered. After cooled, the bulk ferrite powder was pulverized and sieved by means of a sieving shaker attached with screen meshes having opening size of 210 μm and 90 μm. Ferrite powders coated with resin were obtained. The sintering and pulverizing procedure was repeated three times more.

The obtained ferrite powder was sintered at 170° C. for 3 hours in the oven. After cooled, the ferrite bulk was crushed and sieved by the same method as was described above. A resin coated carrier was obtained. This carrier is referred to as carrier (1).

The carrier (1) had mean particle size of 52 μm, weight decrease (H) of 3.7%, amount of coating resin (Rc) of 2.95%, heat decomposition of peak temperature of 295° C. and electric resistance of about $4\times10^{19}$ Ω·cm.

The weight decrease of the carrier (H(%)) was calculated from the amount of the coating resin before heating (Rc(%)) and that after strong heating (Rc'(%)) by the equation described below;

$$H = \frac{Rc - Rc'}{Rc} \times 100(\%)$$

where Rc could be measured as follows.

About 5 g of the carrier coated with resin before heating was placed in a 10 cc of ceramic crucible the weight $W_0$(g) of which had been weighed precisely, and the total weight $W_1$(g) was also weighed precisely. The crucible was placed in a muffle oven and the temperature was raised to 900° C. with heating rate of 15 degree every minute. The crucible was allowed to stand for 3 hours while the temperature was maintained at 900° C. to burn the coating resin up, then allowed to stand to be cooled to the room temperature. Immediately after the temperature reached at room temperature, the crucible with the carrier in it was weighed precisely. The amount of the coated resin (Rc) was calculated by the following equation;

$$Rc(\%) = \frac{W_1 - W_2}{W_2 - W_0} \times 100$$

Rc' was determined as follows.

About 5 g of the carrier coated with the resin was placed in a 10 cc of ceramic crucible the weight $W_0$(g) of which had been weighed precisely, and the total weight $W_1$(g) was also weighed precisely. The crucible was allowed to stand for 2 hours while the temperature was kept at 180° C. and then it was cooled to room temperature. Immediately after the temperature reached at room temperature, the weight $W_2'$(g) of the crucible with the carrier in it was measured precisely. Then, the crucible was placed in the muffle oven and the temperature was raised to 900° C. with increasing rate of 15 degree every minute. The coating resin was burned up while the temperature was kept at 900° C., and the crucible was then cooled to room temperature. Immediately after the temperature reached to room temperature, the weight $W_2$(g) of the crucible with the carrier in it was measured precisely. The amount of the coated resin (Rc') was determined by the following equation;

$$Rc'(\%) = \frac{W_1 - W_2'}{W_2 - W_0} \times 100$$

The particle size of the carrier was measured by a particle size distribution measuring apparatus of laser beam diffraction type manufactured by Microtruck K.K.

Bulk density of the carrier was measured by a bulk density measuring apparatus manufactured by Kuramochi Kagaku Kikai Seisakusho K.K. according to JIS Z2504.

Heat decomposition peak temperature was determined from DSC curve measured by a thermoanalyzer (SSS-5000, made by Seiko Denshi K.K.)

MANUFACTURING EXAMPLE 2 OF CARRIER

A solution containing 80 parts by weight of acrylic resin (Acrydic A-405, manufactured by Dainihon Ink K.K.) and 20 parts by weight of butylated melamine resin was used and the solution was applied on the ferrite powder by means of a spiller coater. After dried, the powder was sintered at 150° C. for 2 hours. After cooled, the bulk ferrite powder was crushed and sieved in a manner similar to Example 1. Ferrite particles coated with acrylic resin. The coating, sintering and crushing and sieving procedure were repeated twice.

The obtained ferrite powder was sintered at 170° C. for 1 hour in a manner similar to Example 1. The obtained carrier coated with resin was referred to as carrier (2).

The carrier (2) had mean particle size of 54 μm, weight decrease of 9.0%, amount coating resin (Rc) of 3.13%, heat decomposition peak temperature of 225° C. and electric resistance of about $2\times10^{10}$Ω·cm.

EXAMPLE 1

A developer was manufactured by mixing 92 parts by weight of the carrier (1) coated with acrylic resin with 8 parts by weight of Yellow toner (1), Magenta toner (1), Cyan toner (1) and Black toner (1), respectively. The components of the toner are listed in Table 1.

A copying machine EP570 (made by Minolta Camera K.K.) was reformed for oil-coating fixation type. The developer was provided with the copying machine under the operation conditions; 200 V of a direct current component imposed as a development bias, and an alternating current component of 2500 Hz in frequency(f) and 500 V in peak-to-peak voltage ($V_{p-p}$) which was superposed on the direct current in the range given by the equation [I].

$$V_{p-p} \leq f + 500 \qquad [I]$$

to evaluate the items below; The individual evaluation was expressed by an average of evaluations with respect to developers for four kinds of color developers.

Electrostatic charge amount

Electrostatic charge amount was measured by a blowing-off method (8% by weight of toner concentration)

Fogs in copied images

Image formation by the copy machine was carried out in the combination of each toner and carrier. The fogs in the copied images were evaluated on the basis of toner fogs formed on a white ground to be ranked. The developer with the rank better than Δ can be put into practical use. The rank ○ is more desirable.

Fine texture in copied image

Image formation by the copy machine was carried out in the combination of each toner and carrier. As for the texture of the copied images, the texture of half-tone images was evaluated to be ranked. The developer with the rank better than Δ can be put into practical use. The rank ○ is more desirable.

Image density (I.D.)

I.D. was evaluated by copying the images under the conditions described above with appropriate light exposure. The density of solid images was measured by Sakura thermometer to be ranked. The developer with the rank better Δ can be put into practical use. The rank ○ is more desirable.

Amount of spent toner

The amount of spent toner after 5000 times of copy was measured. The amount of the spent toner was determined as follows. After the developer was sampled, the toner and carrier were separated from the developer by a blowing-off method. After about 1.00 g of the isolated carrier was immersed in 20 ml of ethanol for 2 hours, the solution was filtrated and the absorbance of the filtrate at 500 nm was measured by a spectrophotometer. A calibration curve was obtained by a separate experiment and the amount of the dissolved dye in the toner is determined from the absorbance at 500 nm. The amount of the spent toner (mg/g of carrier) as an amount of the toner adhered to the carrier was determined from ratio of the value measured above to the amount of the dye contained in the toner.

Environmental variation of electrostatic charge

The difference between the amount of the electrostatic charges ($Q_{LL}$ and $Q_{HH}$) of the developer after 24 hour's storage under conditions of 10° C. in temperature and 15% in relative humidity ($Q_{LL}$), and 30° C. in temperature and 85% in relative humidity ($Q_{HH}$), respectively. The difference (ΔQ)

$$\Delta Q = Q_{LL} - Q_{HH} \ (\mu C/g)$$

was determined and the environmental changes of the electrostatic charge were evaluated to be ranked. The mark X indicates that the developer is impossible to use practically since the environmental changes are too large. The mark Δ shows that the developer of this rank or better than this is practically usable but it is desirable to use the ones with the mark of ○ or better.

EXAMPLE 2

A developer was prepared and evaluated in a manner similar to Example 1, except that Yellow toner (2), Magenta toner (2), Cyan toner (2) and Black toner (2) obtained in Manufacturing Example 2 were used.

The results are listed in Table 1 and Table 2.

COMPARATIVE EXAMPLE 1

A developer was prepared and evaluated in a manner similar to Example 1, except that Yellow toner (2), Magenta toner (2), Cyan toner (2) and Black toner (2) obtained in Manufacturing Example 2 of the color toner were used and the carrier (2) obtained in Manufacturing Example 2 of the carrier were used.

The results are listed in Table 1 and Table 2.

COMPARATIVE EXAMPLE 2

A developer was prepared and evaluated in a manner similar to Example 1, except that Yellow toner (2), Magenta toner (2), Cyan toner (2) and Black toner (2) obtained in Manufacturing Example 2 of the color toner were used and the carrier (2) obtained in Manufacturing Example 2 of the carrier were used without the application of the alternating current bias voltage.

The results are listed in Table 1 and Table 2.

COMPARATIVE EXAMPLE 3

A developer was prepared and evaluated in a manner similar to Example 1, except that Yellow toner (3), Magenta toner (3), Cyan toner (3) and Black toner (3) obtained in Manufacturing Example 3 of the color toner were used and the carrier (2) obtained in Manufacturing Example 2 of the carrier were used.

The results are listed in Table 1 and Table 2.

TABLE 1

| | Toner | Post-treatment agent: Titanium | Post-treatment agent: Silica | Carrier | Development condition |
|---|---|---|---|---|---|
| Example 1 | Yellow toner (1)<br>Magenta toner (1)<br>Cyan toner (1)<br>Black toner (1) | Hydrophobic titanium A (1.0 wt %) | H2000/4 (0.2 wt. %) | Carrier (1) | DC + AC bias |
| Example 2 | Yellow toner (2)<br>Magenta toner (2)<br>Cyan toner (2)<br>Black toner (2) | Hydrophobic titanium B (1.0 wt %) | ↑ | Carrier (1) | ↑ |
| Comparative Example 1 | Yellow toner (2)<br>Magenta toner (2)<br>Cyan toner (2)<br>Black toner (2) | Hydrophobic titanium B (1.0 wt %) | ↑ | Carrier (2) | ↑ |
| Comparative Example 2 | Yellow toner (2)<br>Magenta toner (2)<br>Cyan toner (2)<br>Black toner (2) | Hydrophobic titanium B (1.0 wt %) | ↑ | Carrier (2) | DC bias |
| Comparative Example 3 | Yellow toner (3)<br>Magenta toner (3) | None | H2000/4 (0.5 wt %) | Carrier (2) | DC + AC bias |

TABLE 1-continued

| Toner | Post-treatment agent Titanium | Silica | Carrier | Development condition |
|---|---|---|---|---|
| Cyan toner (3) | | | | |
| Black toner (3) | | | | |

TABLE 2

| | Electrostatic charge [μC/g] | Fogs | Texture | I.D. | Amount of spent toner after 5000 times of copy (mg/carrier 1 g) | Environment change |
|---|---|---|---|---|---|---|
| Example 1 | −15.9 | ○ | ○ | ○ | 26 | ○ |
| Example 2 | −13.8 | Δ | Δ | ○ | 30 | ○ |
| Comparative Example 1 | −11.5 | Δ | x | ○ | 90 | Δ |
| Comparative Example 2 | −11.7 | Δ | x | Δ | 75 | Δ |
| Comparative Example 3 | −19.4 | ○ | ○* | x | 93 | x |

*The Rank of texture decreased to Δ after 1000 times of copy and to x after 2000 times of copy.

What is claimed is:

1. A developing method for electrostatic latent images for developing the electrostatic latent images retained on an electrostatic latent image retaining member, comprising a step of supplying a developer comprising a toner comprising a polyester resin with 2500≦Mn≦12000, 2≦Mw/Mn≦6, 50° C.≦Tg≦70° C. and 80° C.≦Tm≦120° C. and a coloring agent, a carrier comprising a magnetic core material coated with a thermosetting resin in which a styrene-acrylate copolymer resin and melamine resin are cross-linked, and an external additive comprising a hydrophobic silica and a hydrophobic titanium oxide or a hydrophobic silica and a hydrophobic aluminum oxide on a developer retaining member of non-magnetic property which contains a magnetic member in it and is arranged oppositely t o the electrostatic latent image retaining member;

a step of transporting the developer to a developing area which is formed in an opposite portion of the electrostatic latent image retaining member to the developer retaining member; and a step of developing the electrostatic latent images formed on the electrostatic latent image retaining member in the development area under a development bias in which an alternating current component with a frequency of 1000 to 3500 Hz and peak-to-peak voltage of 300 to 2500 V is superposed on a direct current component, wherein the frequency (f) and the peak-to-peak voltage ($V_{p-p}$) have the relation of equation below:

$$V_{p-p}f+500 \quad [I].$$

2. A developing method of claim 1, in which the frequency is in the range of 1000 to 3000 Hz and the peak-to-peak voltage is in the range of 500 to 2000 V.

3. A developing method of claim 1, in which the developer in the step of transporting the developer is regulated to a specified layer thickness by a layer regulating member.

4. A developing method of claim 1, in which the polyester resin contains a modified polyester resin in which a aromatic vinyl monomer is graft-polymerized with an unsaturated polyester resin.

5. A developing method of claim 1, in which the proportion of the modified polyester in the polyester resin is 50% by weight or less.

6. A developing method of claim 1, in which the addition amount of the hydrophobic silica is in the range between 0.1 and 1% by weight.

7. A developing method of claim 1, in which the addition amount of the hydrophobic titanium oxide or hydrophobic aluminum oxide is in the range between 0.2 and 3.0% by weight.

8. A developing method of claim 7, in which the hydrophobic titanium oxide or hydrophobic aluminum oxide comprises small particles having a peak of primary particle distribution in the range of 10 to 20 mμm and large particles having a peak of primary particle distribution in the range of 30 to 60 mμm.

9. A developing method of claim 8, in which the mixing ratio of the small particles with the large particles is from 1:9 to 1:1.

10. A developing method of claim 1, in which the amount of the coating resin on the carrier is from 2.7 to 3.5% by weight on the basis of the carrier.

11. A developing method of claim 1, in which the weight decrease of the carrier is 7% by weight or less when the carrier is heated at 180° C. for 2 hours.

12. A developing method of claim 1, in which a heat decomposition peak temperature of the carrier is 275° C. or more.

13. A developing method of claim 1, in which the magnetic core material has a mean particle size of 40 to 60 μm.

14. A developing method for electrostatic latent images for developing the electrostatic latent images retained on an electrostatic latent image retaining member, comprising a step of supplying a developer comprising a color toner comprising a polyester resin with 2500≦Mn≦12,000, 2≦Mw/Mn≦6, 50° C.≦Tg≦70° C. and 80° C.≦Tm≦120° C. and a coloring agent selected from the group consisting of yellow colorants, magenta colorants and cyan colorants, a carrier comprising a magnetic core material coated with a thermosetting resin in which a styrene-acrylate copolymer resin and melamine resin are crosslinked, and an external additive comprising a hydrophobic silica and a hydrophobic titanium oxide or a hydrophobic silica and a hydrophobic aluminum oxide onto a developer retaining member of non-magnetic property which contains a magnetic member therein and is arranged oppositely to the electrostatic latent image retaining member;

a step of transporting the developer to a developing area which is formed in an opposite portion of the electrostatic latent image retaining member to the developer retaining member; and a step of developing the electrostatic latent images formed on the electrostatic latent image retaining member in the development area under a development bias in which an alternating current component with a frequency of 1000 to 3500 Hz and peak-to-peak voltage of 300 to 2500 V is superposed on a direct current component, wherein the frequency (f) and the peak-to-peak voltage ($V_{p-p}$) have the relation of equation below:

$$V_{p-p} \leqq f + 500 \quad [I].$$

15. A developing method of claim 14, in which the electrostatic latent image is developed in contact with the magnetic brush and the electrostatic latent image retaining member in the developing area.

16. A developing method of claim 14, in which the electrostatic latent image is developed in non-contact with the magnetic brush and the electrostatic latent image retaining member in the developing area.

* * * * *